US005230739A

United States Patent [19]

Bartow

[11] Patent Number: 5,230,739

[45] Date of Patent: Jul. 27, 1993

[54] CONTROLLED APPARATUS FOR PAINTING VEHICLES

[75] Inventor: Douglas H. Bartow, Waterford Township, Waterford County, Mich.

[73] Assignee: Honda of America Manufacturing, Inc., Marysville, Ohio

[21] Appl. No.: 606,081

[22] Filed: Oct. 30, 1990

Related U.S. Application Data

[63] Continuation-in-part of Ser. No. 575,672, Jul. 31, 1990, abandoned.

[51] Int. Cl.[5] ..... B05C 5/00

[52] U.S. Cl. ..... 118/694; 118/315

[58] Field of Search ..... 118/315, 324, 326, 620, 118/694, 309

[56] References Cited

U.S. PATENT DOCUMENTS 4,840,138 6/1989 Stirbis ..... 118/694

5,063,874 11/1991 Dodds et al. ..... 118/326

*Primary Examiner*—W. Gary Jones

*Assistant Examiner*—Charles K. Friedman

*Attorney, Agent, or Firm*—Ronald P. Kananen

[57] ABSTRACT

An apparatus for recirculating a waterbased paint in a vehicle painting assembly line includes paint totes located substantially adjacent a circulating tank near the point of application of the paint, thus reducing line length and the cost of replacing the paint in the line. This feature is enabled because waterbased paints, unlike solvent-based paints, are not subject to the same volume location restrictions. By maintaining a supply of paint to a low volume tank within narrow limits, a high volume application requirement can be met. A single line recirculating system is also disclosed for use with either type of paint. A number of features of a working paint system are also disclosed, including orbital welding of the stainless steel tubing, passivation of the line, use of DI water for passivation and flushing of the system, low point drains for the system, limited surge, and the use of smooth bore components and transitions to avoid paint sedimentation and buildup.

10 Claims, 13 Drawing Sheets

CONTROLLED APPARATUS FOR PAINTING VEHICLES

CROSS-REFERENCE TO RELATED APPLICATION

This application is a continuation-in-part of U.S. application Ser. No. 07/575,672, filed Aug. 31, 1990; now abandoned.

BACKGROUND OF THE INVENTION

This invention relates to a method and apparatus for applying waterbased paint to a vehicle such as an automobile. More particularly, this invention relates to a paint application and circulation system for applying waterbased paint to a vehicle wherein the paint supply is near or adjacent the point of application. Still more particularly, this invention relates to a low volume content paint supply system employing methods and apparatus for supplying a high volume paint application without resulting in production downtime. Still more particularly, this invention relates to a number of features in such a system for quality control purposes and operator convenience.

The paint finish on a new vehicle is often regarded as the single most noticeable visual feature of the vehicle. When the finish is smooth, even, and attractive, owners are influenced as to the quality of the vehicle, while when contamination, paint unevenness, and other defects are present, the owner is more likely to complain to the vehicle dealer, and attribute a lack of quality to the vehicle itself. Accordingly, vehicle manufacturers and paint suppliers have expended vast amounts of money, effort, and ingenuity to produce quality paints and high quality yet efficient methods of applying those paints to the surface of the vehicle.

It is well known that automotive vehicle production is automated to a significant extent. Indeed, paint is applied to the vehicle while traveling an assembly line by positioning paint booths through which the vehicles travel to receive various coatings of paint. Such techniques are highly developed and include the use of robots to apply the surface paint to the vehicle and to paint door jambs and the like. In the past paint have used structures housing solvent-based paints which must have special explosion proof features such as grounded electrical connections and pressure releasing walls which respond to an explosion, and be located away from the factory. Such requirements of explosion proof systems for high volume storage of either waterbased or solvent-based paint are necessary for safety, but are costly when handling high volumes of either waterbased or solvent-based paints. The capital expense for such structures and long piping lines, with the accompanying pumping cost, is high. Moreover, the amount of paint in the lines which is effectively inventoried is high. For example, a line of 3000' for example, could contain more than 500 gallons of paint which is lost during color changeover, or if there is a change in the paint. In addition, prior paint circulation systems utilized large storage tanks wherein the entire content might be lost or its quality affected during changeover.

When the paint supply is located at such a distance from the point of application, significant pumping energy is required for the viscous paint. The friction generated by pumping for such long distances, and the fact that the piping may be required to pass through hotter areas of a factory, en route from the structure housing the paint to the paint booth locations in the factory, tend to increase the temperature of the paint, affecting its viscosity. Therefore, heat exchangers or other temperature control devices are usually needed to maintain the paint temperature stability in such a paint system.

Solvent-based paints have the potential for drawing environmental attention to the solvent emissions during utilization. Primer coats and clear coats have a high application efficiency when an electrical potential is used, so that solvent emissions can be reduced. However, unfortunately, color coats are adversely affected by the sole use of an electrostatic application, so that their application efficiency is low and their solvent emissions are higher.

Thus, it is desired to utilize waterbased paints to address environmental concerns resulting from the use of solvent-based paints, while maintaining the quality of the finish on the vehicle.

Moreover, it is a problem in such paint circulating systems to reduce the capital expense for preparing painting systems, and to reduce the amount of paint in the painting lines which is lost during paint changeover, or if there is a difficulty with the paint. In addition, it is a general overall aim in developing and implementing a paint recirculating system to provide for ease of maintenance and replacement. These and other objectives are met by this invention.

Thus, it is an overall general objective of this invention to provide a paint recirculating system wherein a waterbased paint source and the paint system is located adjacent to or near to the point of application in lieu of a typical paint supply source located a great distance from the application point.

It is an objective of this invention to provide a waterbased paint system which uses handling procedures and monitoring methods to reduce the paint volume contents of a local relay room for the paint system to provide a safe environment.

It is another overall objective of this invention to provide a low volume waterbased paint supply source for a high volume usage spray painting application which uses methods and apparatus for assuring that the paint supply is not interrupted.

It is another overall objective of this invention to provide a waterbased paint recirculating system which uses a single line for supply to the waterbased paint drops and return to the circulating tank.

It is another objective of this invention to shorten the piping run from the paint source and the circulating tank to the point of application for a waterbased paint, thereby reducing the amount of paint inventoried in the line and thus reducing the cost of replacement when necessary.

It is another objective of this invention to provide a local booth side system to achieve a major cost reduction of a high purity stainless steel system.

It is still another feature of this invention to provide a piping system which avoids locations which tend to induce paint buildup or sedimentation by using, for example, stainless steel piping which is orbitally welded and then passivated.

These and other objectives of this invention will become apparent from a detailed written description of the invention which follows taken in conjunction with the accompanying drawings.

BRIEF SUMMARY OF THE INVENTION

Directed to achieving the foregoing objectives and addressing the problems with prior art paint recirculating systems, the apparatus according to the invention features the use of a total paint supply system including a tote and a recirculation tank which are at or nearer to a paint spray booth or other point of application than in prior art systems, including solvent-based systems. The apparatus according to the invention includes a source of waterbased paint, such as a tote and a circulation tank, located adjacent to or nearer to the application points than permitted with typical paints; a circulating tank for receiving paint from the tote; means for delivering paint to a predetermined number of drops in a painting booth for painting an automotive vehicle; and means for returning paint to said recirculating tank. The circulation tank includes agitation mean for stirring the paint in the tank, and a level sensing device for maintaining the level of paint in the circulation tank within predetermined narrow limits. This feature permits the use of a low volume supply for a high volume paint requirement and is a significant feature of the invention. The apparatus includes monitoring means for tracking the use of paint through the process to assure that the supply of paint to the high usage volume point of application is not interrupted from the low volume supply.

The invention related to the waterbased paint is characterized in that a non-explosion proof electrical system may be used in a standard relay room housing, not requiring explosion-proof characteristics, for housing the circulating tank and the tote. For such waterbased paints, the invention is further characterized by the absence of a need for temperature control since the paint source is so near to the paint booth wherein the supply and return lines are relatively short, and do not pass through hot or cold areas of the painting system in the factory. Other advantages of the invention include low point drains in the system to facilitate drainage and testing; a short piping loop for clean-out; sanitary fittings; smooth bends and transitions in the piping; orbital welding for the stainless steel fittings; a limited surge of pressure in the system; and rapid changeover to new material.

The method according to the invention includes a step of providing a paint supply system including a tote having a water-based paint and a circulating tank in a relay room nearer to the point of application than the case for a solvent based paint or waterbased paint; providing said waterbased paint to a circulating tank in the relay room; transferring said paint to drops in a paint booth by way of a supply line; and returning unused paint to said circulating tank through a return line.

Another aspect of the invention includes a plurality of totes; a plurality of circulating tanks located in a relay room adjacent said totes for receiving paint from said totes; a paint booth having a plurality of paint drops positioned relative to the passage of an automobile body therethrough to paint said body; a plurality of pipes respectively connected to said circulating tanks and traversing a side of said booth at a location below the level of said vehicle passing through said booth, said supply pipes passing beneath an end of said booth; and a plurality of return lines.

A significant feature of the invention relates to the use of a relay room near the paint booth wherein the relay room need not be explosion proof, arranged so that low volume circulating tanks can supply the high volume requirements of the paint booth without interruption. Means are provided throughout the system for automated monitoring of the process.

These and other features of the invention will be well understood from a detailed description of the invention which follows.

DETAILED DESCRIPTION OF THE PREFERRED EMBODIMENTS

Figure 1:
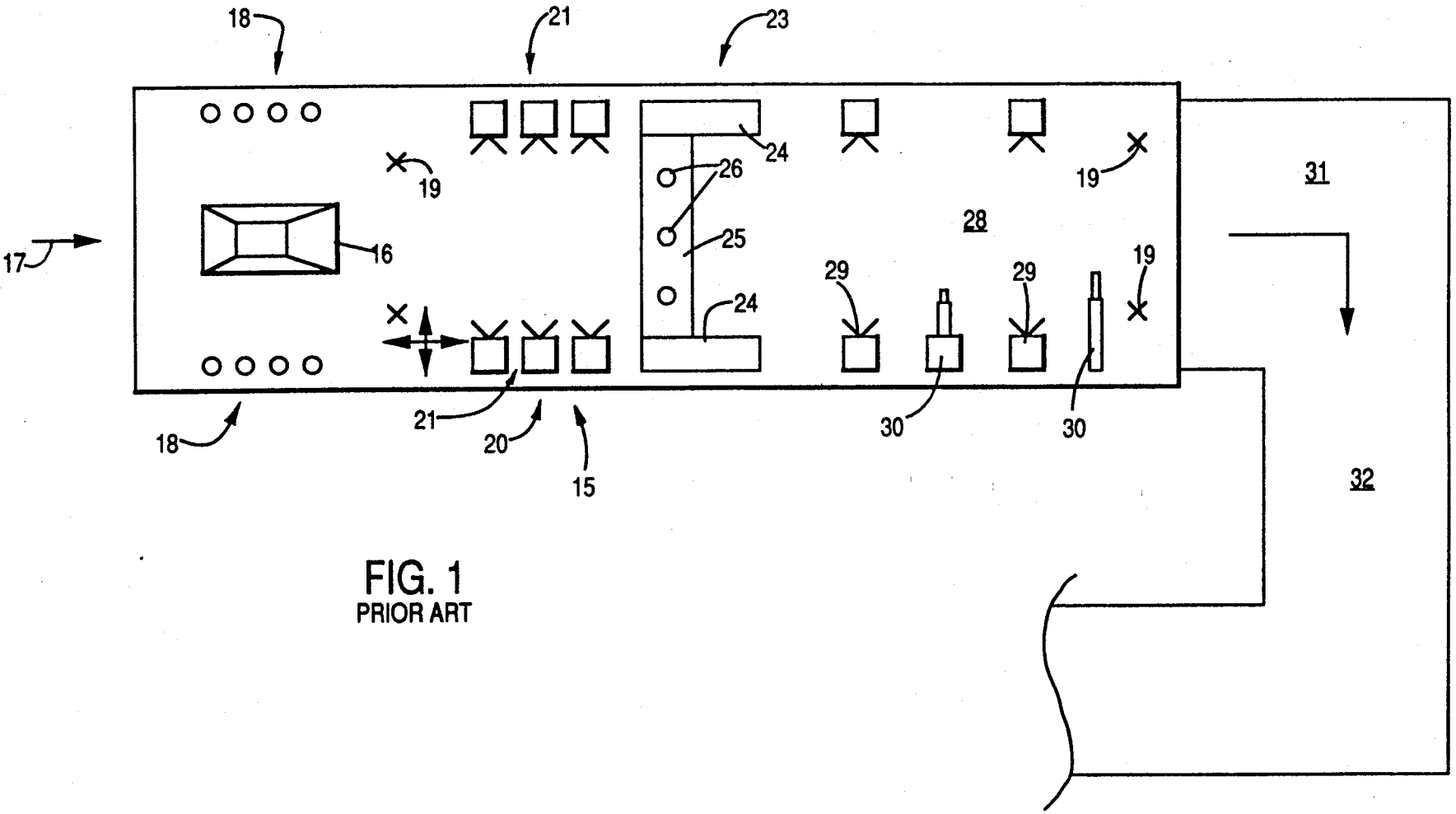
FIG. 1 PRIOR ART
FIG. 1 is a plan view of a typical and conventional paint booth in a paint shop.

A typical prior art painting booth is shown in FIG. 1 at the reference number 15 for painting a vehicle 16 while within the booth 15 traveling in the direction of the arrow 17 on the assembly line. A plurality of robots 18 are mounted on opposed sides of the booth 15 for painting a dry body of the vehicle 16. A portion of the vehicle 16 may be painted manually from the positions noted by the reference numeral 19, such portion including difficult-to-reach locations. At the next application stage 20, a plurality of side mounted robots 21 apply paint to the sides of the vehicle 16 in a carefully arranged pattern at a rate designed to completely cover the vehicle to a desired thickness, sometimes depending on the color. Typically, such a pattern resembles a "back and forth" or "to and fro" pattern along the side panels of the vehicle 16. Such robots may include electrostatic apparatus for charging the paint to a negative potential to assist its adherence to a vehicle 16 which is grounded or at a positive electrical potential. Such a technique is well known and commercially available from a source such as Behr Engineering in Germany.

At the stage 23, the horizontal surfaces of the vehicle 15 are painted by an apparatus having side guides 24 along which moves a transverse member 25 having a plurality of paint spray nozzles 26 mounted to face generally downwardly. Typically, the nozzles 26 paint in a back-and-forth or to-and-from pattern to assure a complete even coverage of the horizontal surfaces of the vehicle 15. A final painting zone 28 having a plurality of painting nozzles 29 and a plurality of horizontally extendible nozzles 30 complete the painting of the vehicle 15 which then passes along the path 31 to a drying zone 32. For solvent-based paints, the drying zone is controlled to a relatively hot temperature to drive off the solvents which require careful handling to comply with environmental regulations. A significant advantage of painting with waterbased paints according to the invention is their ease of handling with respect to environmentally-sensitive emission matters.

A paint booth 15 such as is shown in FIG. 1 is generally mounted in a factory building such that the level at which painting occurs is somewhat intermediate an upper level and a lower level which receives the emitted, but unapplied paints for disposal. As used in this specification, spray locations at the heads 21, 16, 29, and 30 are generally referred to as "drops" or "paint drops".

Figure 2:
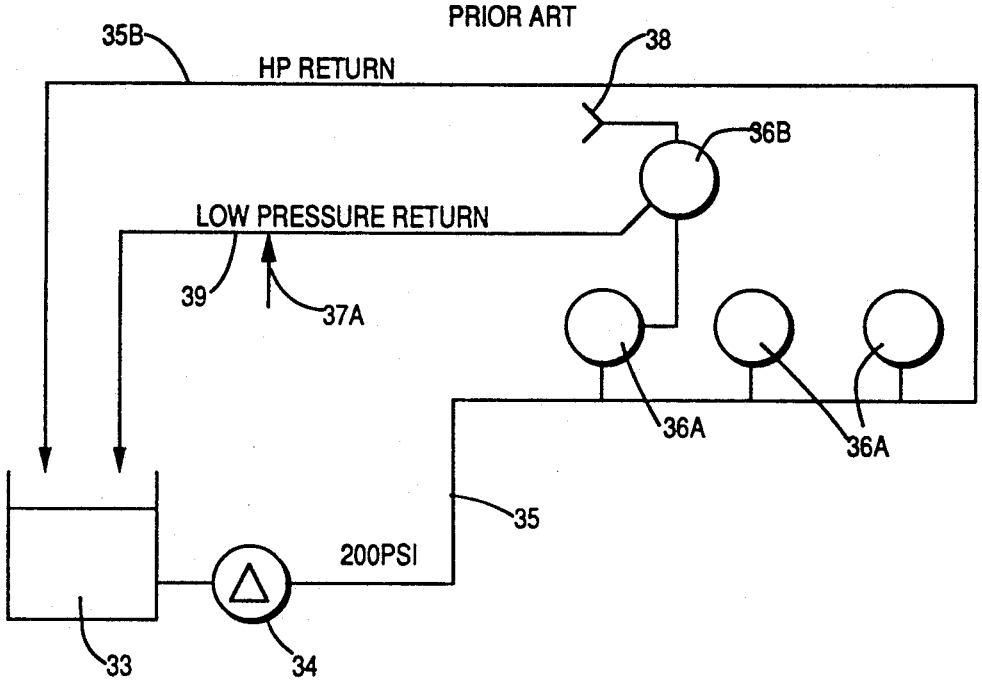
FIG. 2 PRIOR ART
FIG. 2 is a block diagram of a conventional prior art three pipe system used for applying solvent-based paints to vehicles.

FIG. 2 is thus an example of a conventional 3-pipe system used for applying solvent-based paints to vehicles. Thus, a supply tank 33 provides agitated paint to a high pressure pump 34 providing paint at a high pressure of about 200 psi on a high pressure supply line 35 to a plurality of regulators 36A, each of which is connected to a low pressure recirculating regulator 36B to reduce the pressure to about 25 psi to a representative drop 38. The outlet of the low pressure regulators 36B provides a low pressure return on the line 37A to the tank 33. A high pressure supply line 35 continues around all booths to the furthest-most or last required paint drop condition and at that point becomes the high pressure return line 35B and continues back to the paint tank 33 located in the external paint mix building to keep the paint circulating throughout the piping network. Such 3-pipe systems have served well for their intended purpose, but have sometimes suffered from wide pressure variations on the order of 50 to 100 psi stemming from a difficulty in balancing the relatively-complicated system. A main feature of the invention therefore is to simply the system of FIG. 2 to a single pipe system suitable for use with waterbased paints and for solvent-based paints as well.

Figure 3:
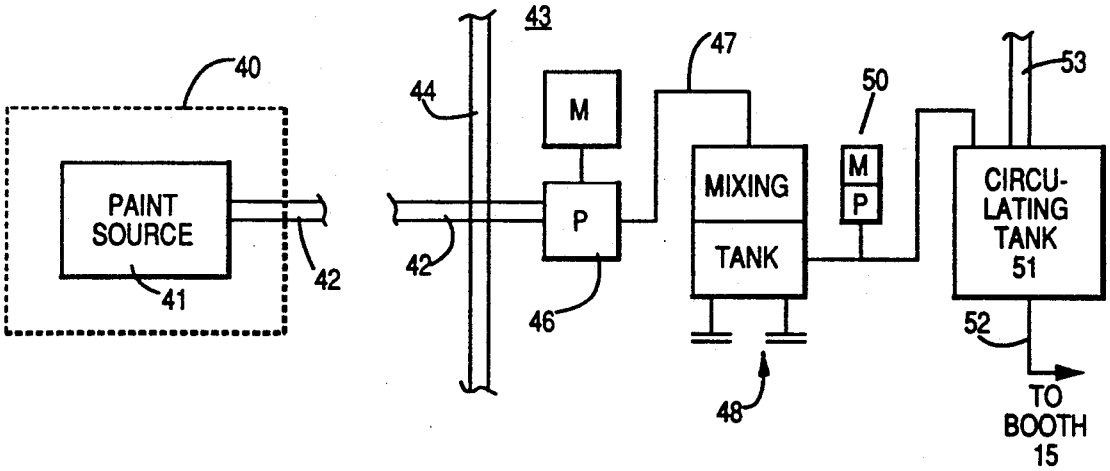
FIG. 3 PRIOR ART
FIG. 3 is a typical prior art installation showing a paint supply located significantly far from the point of application.

FIG. 3 is still another prior art block diagram showing a tote location and pumping station at location 40 housing a plurality of totes 41 at a location significantly remote from the paint spray booth, where mixing tanks 48 and circulation tanks 51 and pumping stations are located for solvent-based paints. Typically, by code, a solvent-based paint system is located some 80 or 90 feet from the main factory facilities in a paint mix building 40 having an explosion-proof environment, such as a class 1, division 1 environment with explosion-relief walls, grounded components, and an explosion-proof electrical system. Such features are a costly, but necessary adjunct to storage and delivery systems for solvent-based and waterbased paints necessitating a significant capital expenditure. The paint application booths are a significant distance from the building due to process layout.

In addition, such a distance requires additional pumping capabilities to move a viscous paint through the required separation distance. In addition, the volume of paint stored in the lines is significant for such a paint loop having an overall length of 3000 or 4000 feet of 2" line holding some 500 to 600 gallons of paint having an average cost of perhaps $40 to $50/gallon. When a paint color is changed, or at model changeover, or when a defective paint is discovered, a loss of that amount of paint is significant but is necessitated by the requirements for handling paint products.

At the pumping station located in its space 40 paint is withdrawn from the base of the mixing tank 48 and pumped by a pump 50 to a circulating tank 51 having its outlet connected to a supply line 52 for providing the spray paint booth locations typically away from housing 40 to a plurality of drops in the paint booth 15. The return lines 53 provide a return for the paint to the circulating tank 51 located in housing 40 from the paint booth 15.

Figure 4:
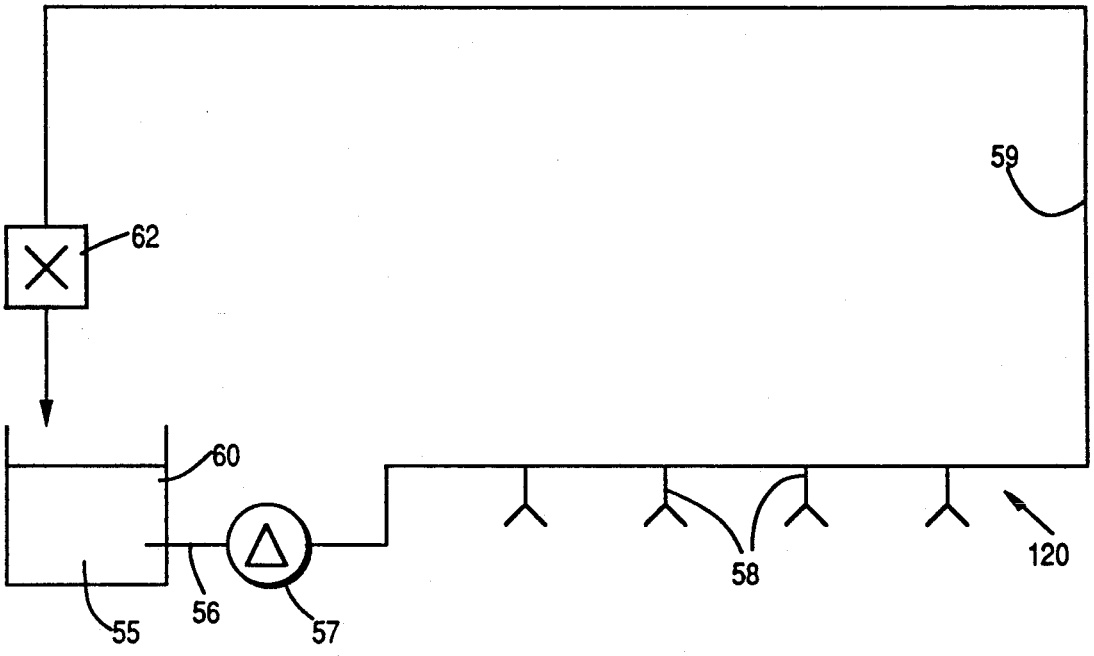
FIG. 4 is a block diagram of a single pipe system according to the invention for applying waterbased paint to the vehicle in the system according to the invention.

The basic premise for the paint circulating system according to the invention is shown in FIG. 4 where a circulating tank 55 has its outlet connected to a conduit 56 and a pump 57 to a plurality of drops 58 located in a paint booth 15 in the system. A single return line 59 returns paint to the circulating tank 55. A feature of the invention is that the recirculating tank 55 has a limited capacity and the paint level is maintained within a narrow band so that the interior walls on the recirculating tank 55 do not dry before a replacement supply of paint is provided to return the tank to an optimum level 60. Typically, the control level in the tank 55 is maintained within a 2" to 3" band. This notion permits a low volume source to service a high volume usage in a paint booth.

The system of FIG. 4 has an advantage of providing a high pressure return through a back-pressure regulator 62 and no requirement for a low pressure return. Such a system permits a number of capital advantages in reducing the number of lines required compared to the prior art system of FIG. 2 and reducing pressure in the main header without inducing heavy shear points.

As an overall indication of the characteristics of the system according to the invention, it should be noted that a number of features are provided to prevent paint buildup and paint sedimentation in the system. For example, since water-based paints have a high content of DI water, the product is extremely corrosive, and requires high purity stainless steel construction material to prevent system corrosion which can cause paint contamination. Each of the stainless steel pipes is a seamless pipe having its end orbitally welded to the adjacent line to provide a smooth interior passageway. The preferred components are Type 304 and Type 316 stainless steel, 150 grit surface finished products, while products requiring welded fabrication are of the low carbon content or Type 304L and Type 316L steel. Orbital welding techniques for stainless steel to provide such smooth interior passageways are well known in other industries, but have heretofore not been applied to automotive paint recirculating systems. During welding, the piping and weld head are purged with argon gas to prevent weld sugaring and use of L-grade stainless steel to prevent inter-granular precipitation. Each of the pipes has a smooth bend with a large turning radius to avoid creating a locus for sedimentation of the paint or paint buildup. Clearly, paint buildup or sedimentation is undesirable for if a "glob" of paint reaches a drop and is deposited on a surface of the vehicle, the vehicle would need to be removed from the assembly line, sanded, and returned for repainting. Thus, the system is engineered to keep the paint continuously fluid within the system.

Another feature of the invention resides in the passivation of the lines prior to initial usage. Orbital welding of the stainless steel pipes exposes some carbon from the metal at the welded joint area. A suitable cleaner, such as an alkaline cleaner and DI water solution heated to 140 degrees F., is passed through the piping, followed by a solution of an acid, such nitric acid and hot (140 degrees F.) deionized (DI) water in a proper ratio, such as 15:85. The solution is circulated through the piping for about 1 hour and the system is then flushed with DI water. Such a treatment makes passive any exposed carbons which could cause rust or corrosion and inhibits rusting of the metal. Such passivation techniques for stainless steel are known in the food industry, but have not heretofore been applied to automotive paint recirculation systems.

Another feature of the system is its utilization of low point drains under the booth 15 so that the system can be flushed with DI water for cleaning, such as when changing colors or when there has been an incident of sedimentation. With both the supply lines and the return lines below the grade of the paint booth 15, such cleaning is facilitated.

Figure 5:
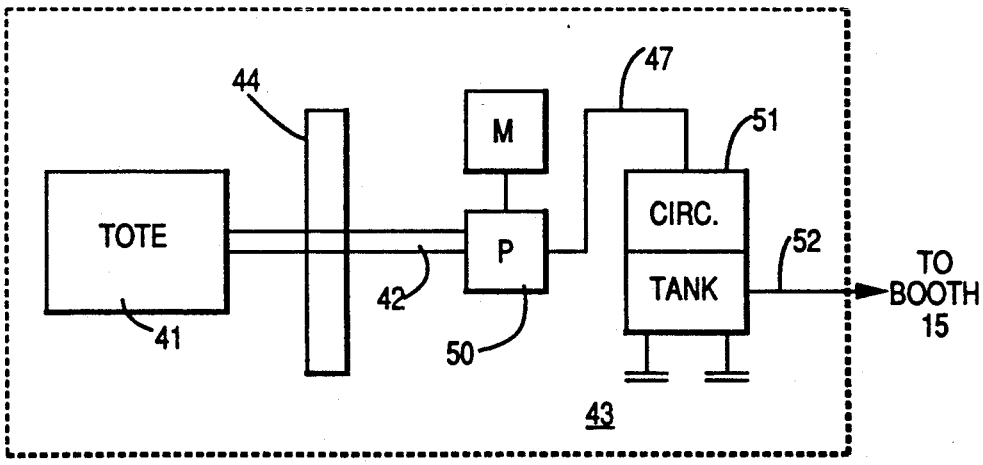
FIG. 5 is a view showing a relocation, according to the invention of the tote and low volume circulation taken adjacent to or near the point of application.

FIG. 5 contrasts the system of the invention with the prior art system shown in FIG. 3 where like reference numerals are used to indicate like parts. It should be noted that a significant feature of the invention is that the tote 41 and the circulating tank are within the relay room 43, that the mixing tank is unnecessary, and that the relay room contains all of the total pumping station. Thus, paint from the tote is provided directly to the circulating tank 51 for transmission to the booth 15. It should also be noted that the room 40 (FIG. 3) for the totes 41, the pumps 50, the circulation tanks and transport piping member 52 is eliminated since the paints are waterbased and designed within the regulatory restrictions regarding the paints used. Recognition of that property and its utilization in developing the waterbased system of FIG. 5 is an important discovery on which the invention is bottomed.

Among the advantages of the system of FIG. 5 according to the invention is that the capital expenditures for piping are significantly reduced because the tote 41, pumps and tanks all in the relay room 43 are located adjacent or near the paint booth 15. Moreover, the length of the paint loop around the booth can be reduced, and transport piping is non-existent due to absence of the externally-located paint building to thus reduce the inventory of paint in the piping network. As a practical example, it was possible to reduce the loop length to about 520'. This reduction is significant when the paint in the loop must be discarded for color change, for example, or for model changeover; there, the paint in the system is wasted at an average cost on the order of $50 per gallon. Thus, significant savings are realized when it is remembered that a number of colors are involved. For the system contemplated, ten basic colors are utilized for a single paint booth; however, the system is arranged for multiple booths and planned for an additional 10 colors.

A tote 41 is the conventional manner of providing paint from the manufacturer to the ultimate user. The paint tote selected for this design is on the order specific for this design to meet codes of 275 gallons, while a circulating tank 51 is on the order of 50 gallons. These volumes permitted the use of a specific amount of paint within the factory at the point of application, while meeting codes. The arrangement is metered so that an alarm is sounded to warn of an impending need for a new tote; thus "just-in-time" inventory techniques can be applied using the system of the invention.

Thus, the system provides paint safely and in compliance with applicable local codes and state and federal laws to a high volume paint spray application from a local paint delivery system, wherein the amount of paint contained at the local delivery system must be minimized to specific and stated amounts, even in the case of waterbased paints. Where local codes vary and have an effect on the amounts of contained materials allowed, the system can conform to those differences by altering tank sizes, paint level (by adjusting the level sensor probes) and by altering paint tote size and by altering the number of totes allowed to be on line at any given time. For example, if the local or state code restricts the amount of paint allowed in a relay room to 500 gallons, and 10 colors are required, 10 recirculating tanks of 40 gallons each will be within the code requirements for a total of 400 contained gallons. If the number of colors increases to 20, the level sensors can be altered so that 20 tanks each have 25 gallons for a total containment of 500 gallons, within the code restrictions. By limiting contained values to less than exempt amounts, the relay room is thus not rated as a hazardous environment and it does not require explosion proof electrical components for control devices, electric motors on agitators, pumps, room lighting, and so forth, and the building itself is not required to be explosion proof. These features result in significant cost savings.

Figure 6:
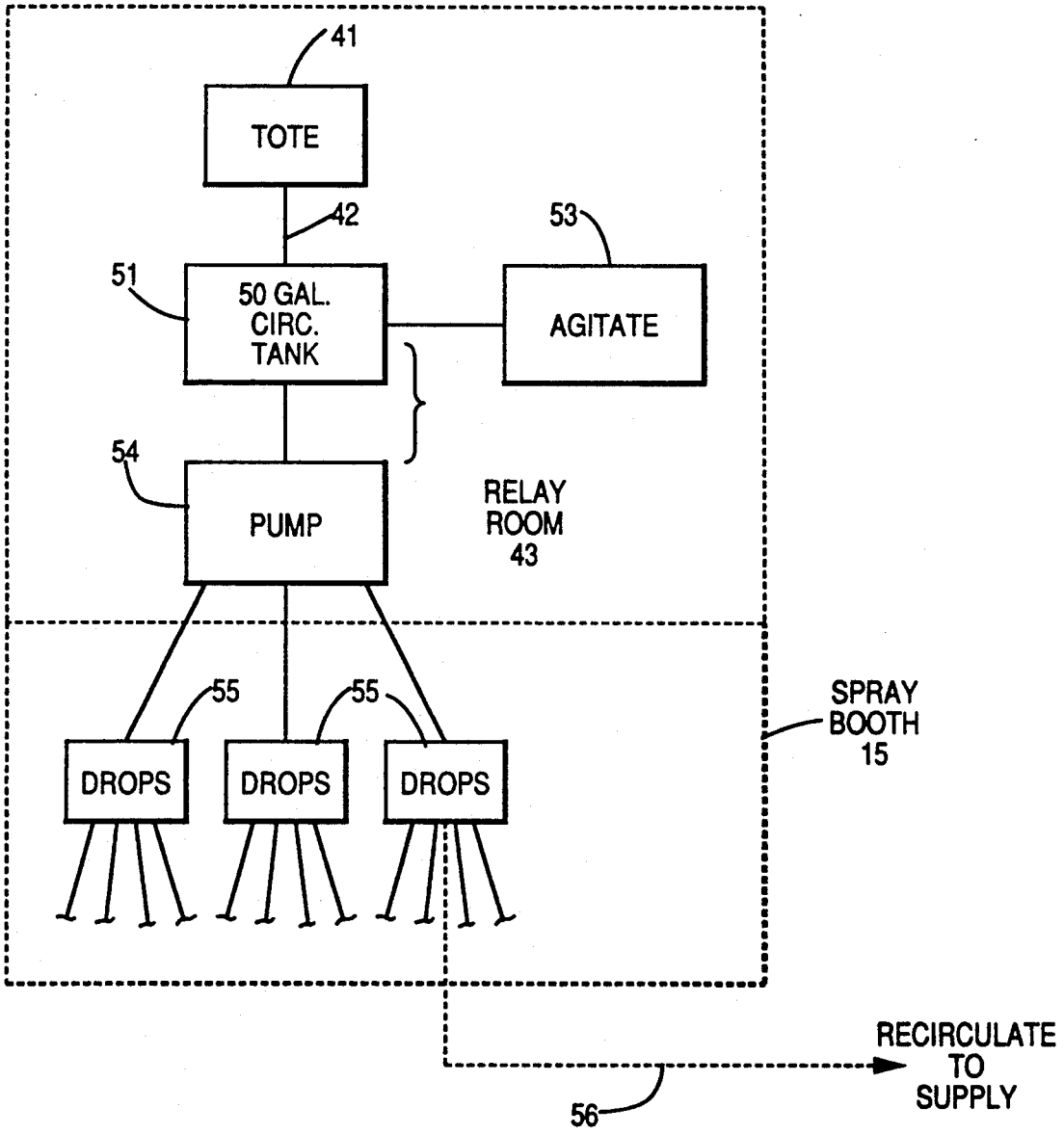
FIG. 6 is a block diagram showing the concepts of the invention for circulating waterbased paints in a painting apparatus and method according to the invention.

FIG. 6 shows a flow diagram for the steps according to the invention. The method of recirculating a waterbased paint for application to a vehicle, such as an automobile, in a paint zone in an assembly process, includes a step of providing a waterbased paint, such as in a tote 41. The method further includes the step of providing the paint from the tote 41 to a circulating tank 51 located in a relay room 43 beneath the mezzanine adjacent to the paint booth 15, while continuously agitating the paint, as shown in the step 53. The paint from the circulating tank 51 is provided by a pump 54 located in the relay room 43 to a plurality of drops 55 located in the spray booth 15. The method concludes with the step of recirculating the paint to the supply tank 51 through the return lines 56

Figure 7:
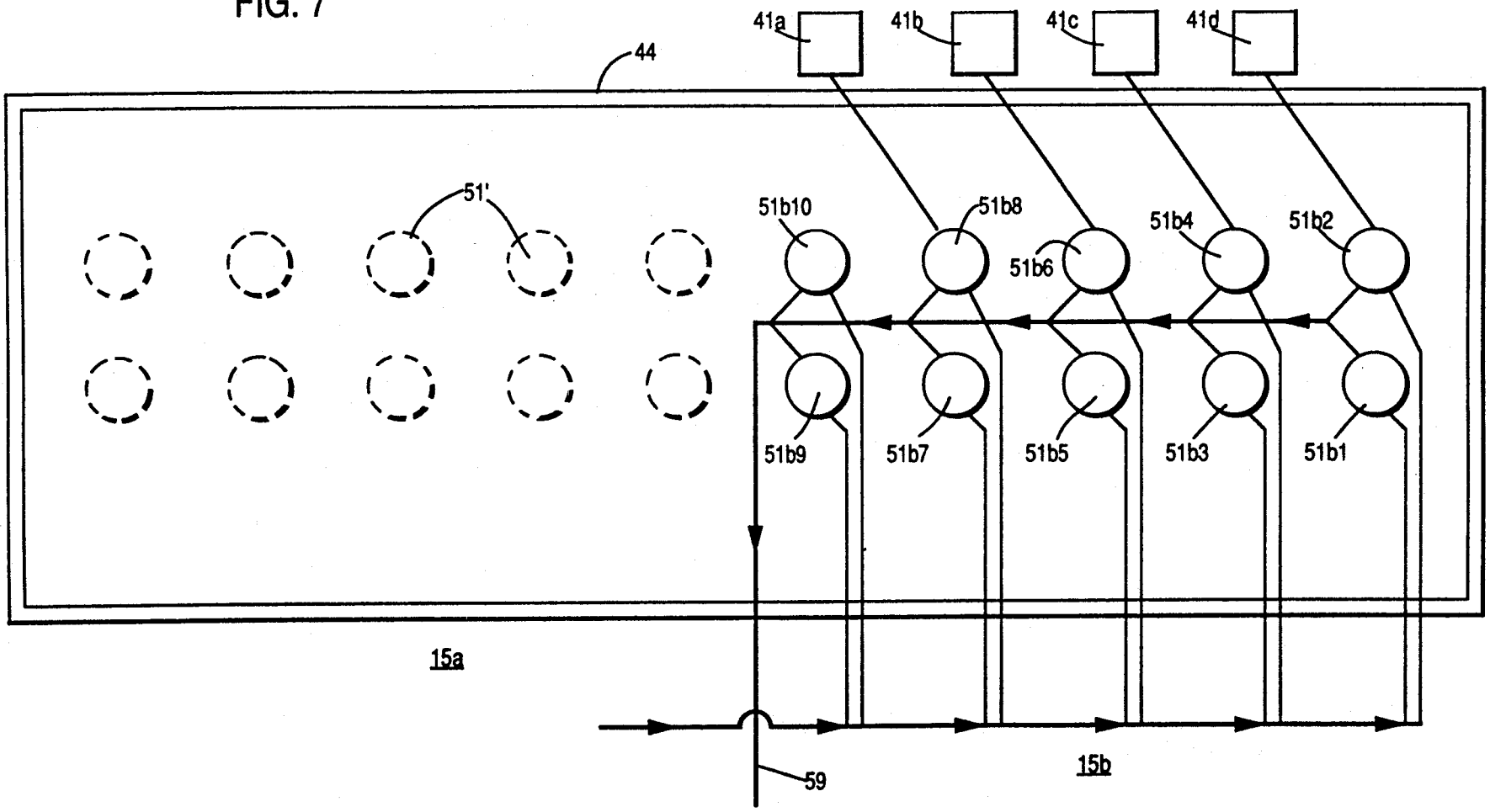
FIG. 7 is a partial plan view of a waterbased paint circulating system according to the invention showing totes, circulating tanks, and supply and return lines to and from the paint booth on the assembly line.

FIG. 7 shows a plan view of the paint circulating system according to the invention in a preferred piping embodiment, representatively showing a situation where a paint booth **15*a* is in operation while an adjacent paint booth 15*b* is available for expansion of the system. Thus, a plurality of totes 41*a* to 41*d* are provided outside the wall 44 for supplying paint to a plurality of circulating tanks 51*b*1 to 51*b*10. The circulating tanks are respectively connected to a plurality of supply lines 52*b*1 to enable that sampling line becomes return 52*b*10, while a like plurality of return lines 59 respectively return paint to the tanks 51. A plurality of further tie in points 51' are available for expansion to serve the second paint booth 15*b***.

Figure 8:
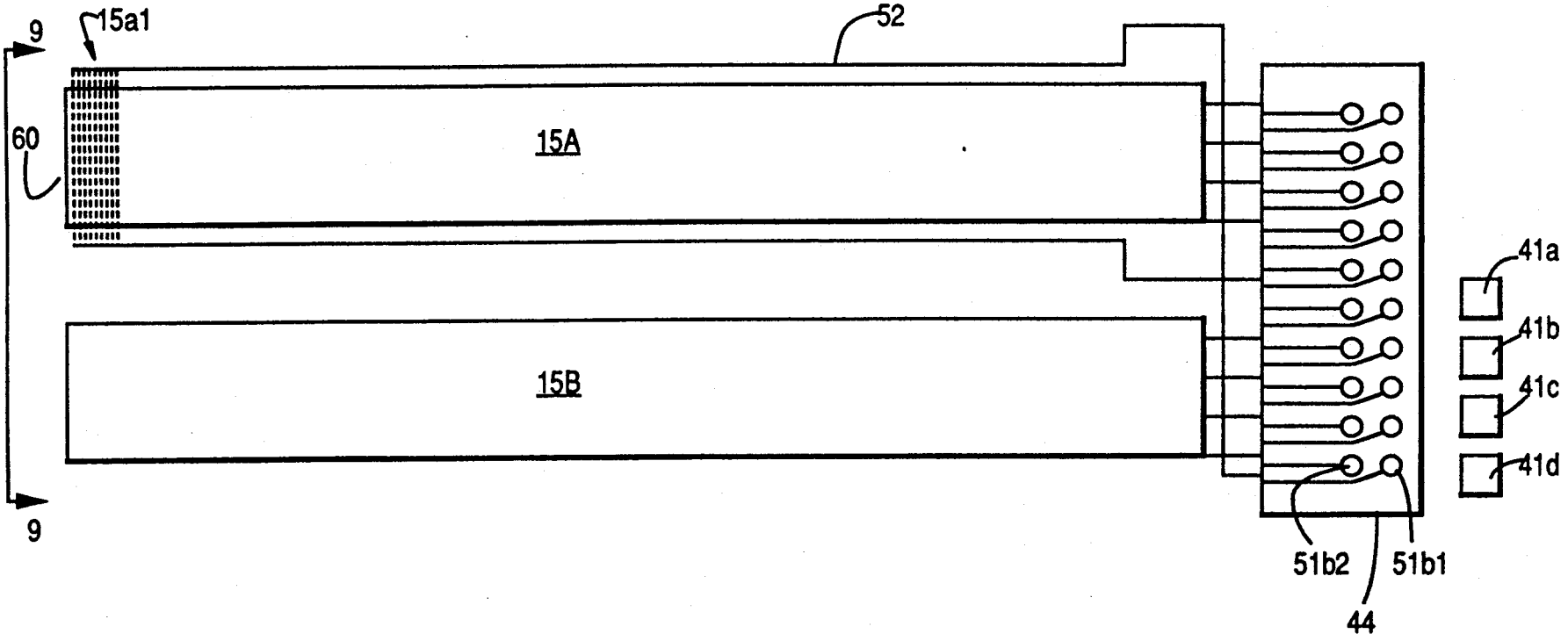
FIG. 8 is a plan view of the circulating tanks and supply and return lines to a pair of painting booths, further showing piping crossover at the end of the booths.

FIG. 8 shows a plan view of the paint booths **15*a* and 15*b* relative to the totes 41*a* to 41*d*, the wall 44, the circulating tanks 51*b*1 to 51*b*10 and the tanks 51' available for expansion. The supply pipes cross under the booth 15***a* at its end 15*a* remote from the tanks 51 as shown generally by the reference numeral 60. Otherwise, the reference numerals used in connection with FIG. 8 are like those used in connection with FIGS. 5 and 7.

Figure 9:
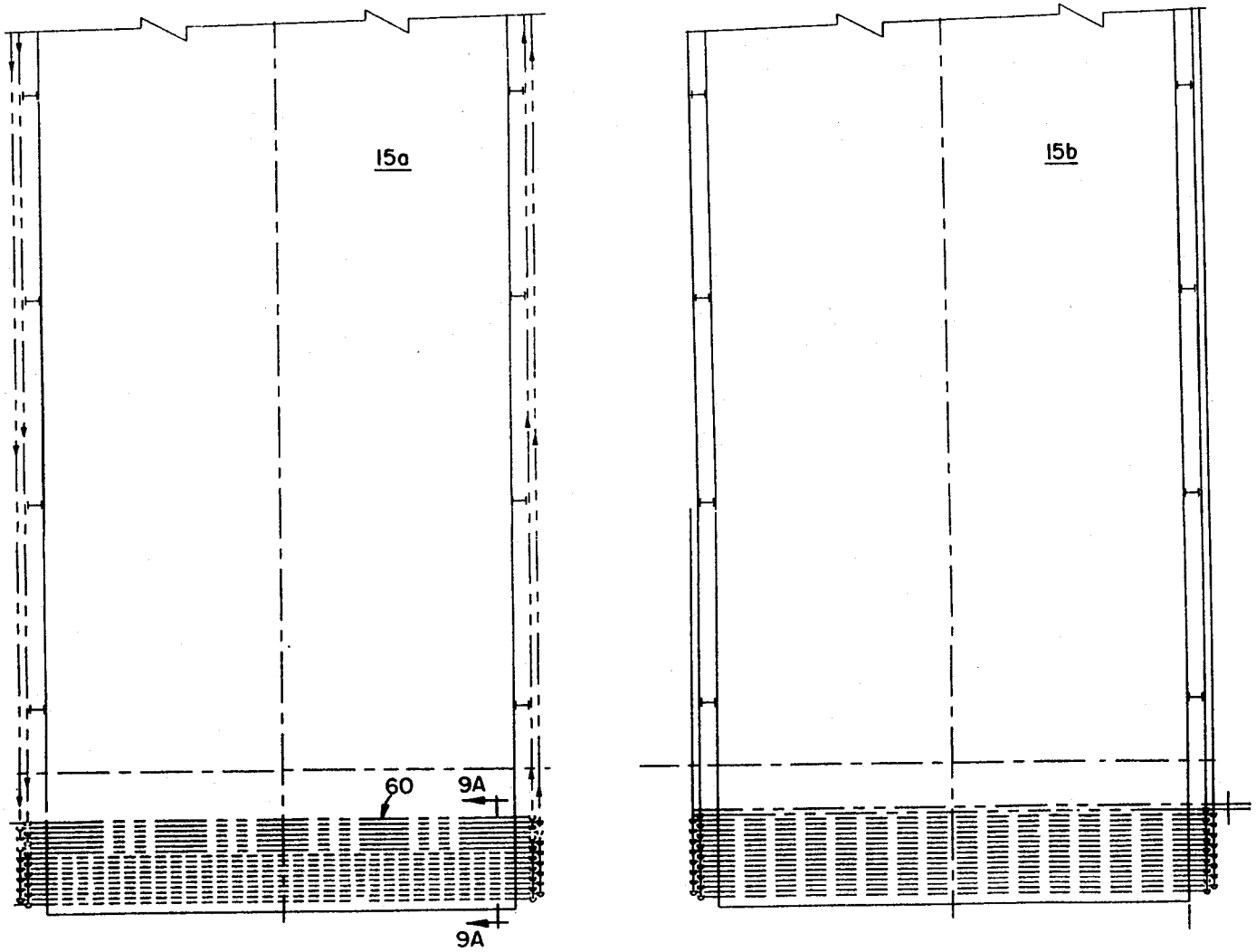
FIG. 9 is a rear elevational view of a paint booth showing crossover lines beneath the floor of the booth.
Figure 9A:
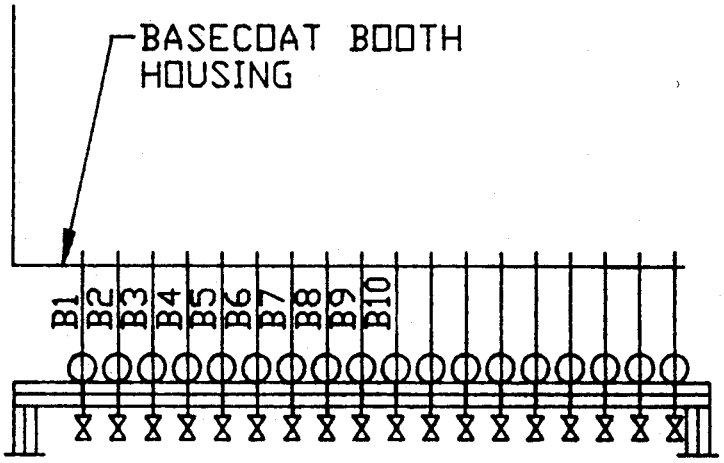
FIG. 9A is the basecoat booth housing taken from line *9a—9a* of FIG. 9.

FIG. 9 is an end view of the paint booths 15*a* and 15*b* taken from line 9—9 in FIG. 8 showing the crossover pipes 60 beneath the painting level of the booths 15. Otherwise, like reference numerals are used as in connection with FIGS. 7 and 8.

Figure 10:
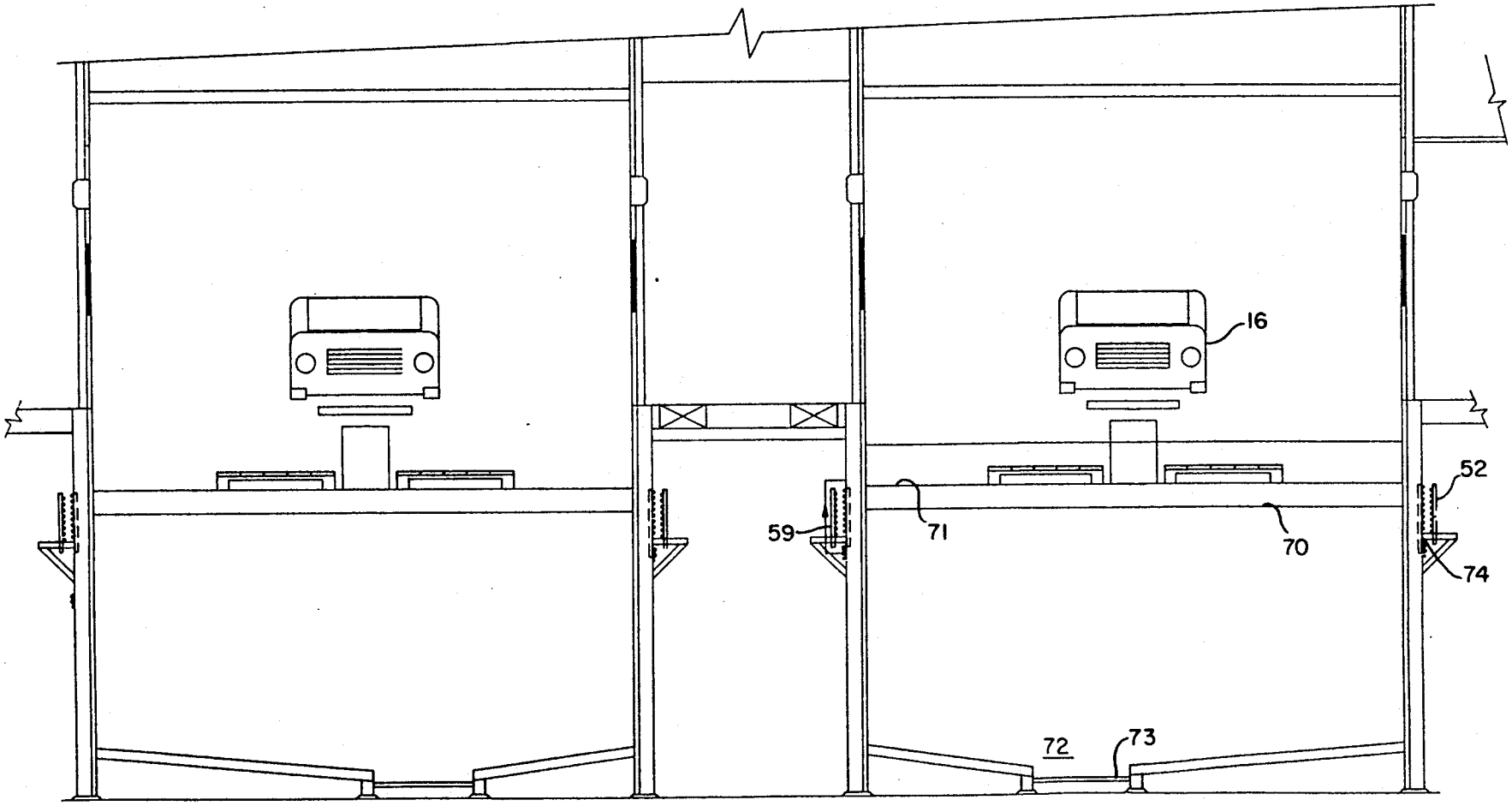
FIG. 10 is a simplified cross sectional view through a paint booth showing the elevations of the floor, sump, and supply and return lines.

FIG. 10 is a side cross sectional view of a paint booth 15 showing its elevation. The mezzanine level is shown at the reference numeral 70 above which a vehicle 16 passes for painting as previously described. Gratings 71 are provided through which unused paint falls to a lower area 72 for runoff with water to a drain 73 where the waterbased paint and water are treated ecologically and the unused paint recovered. The supply lines 52 are shown in cross section. For flushing and cleaning, DI water is available at the line 74. The return lines 59 are also seen.

Figure 11:
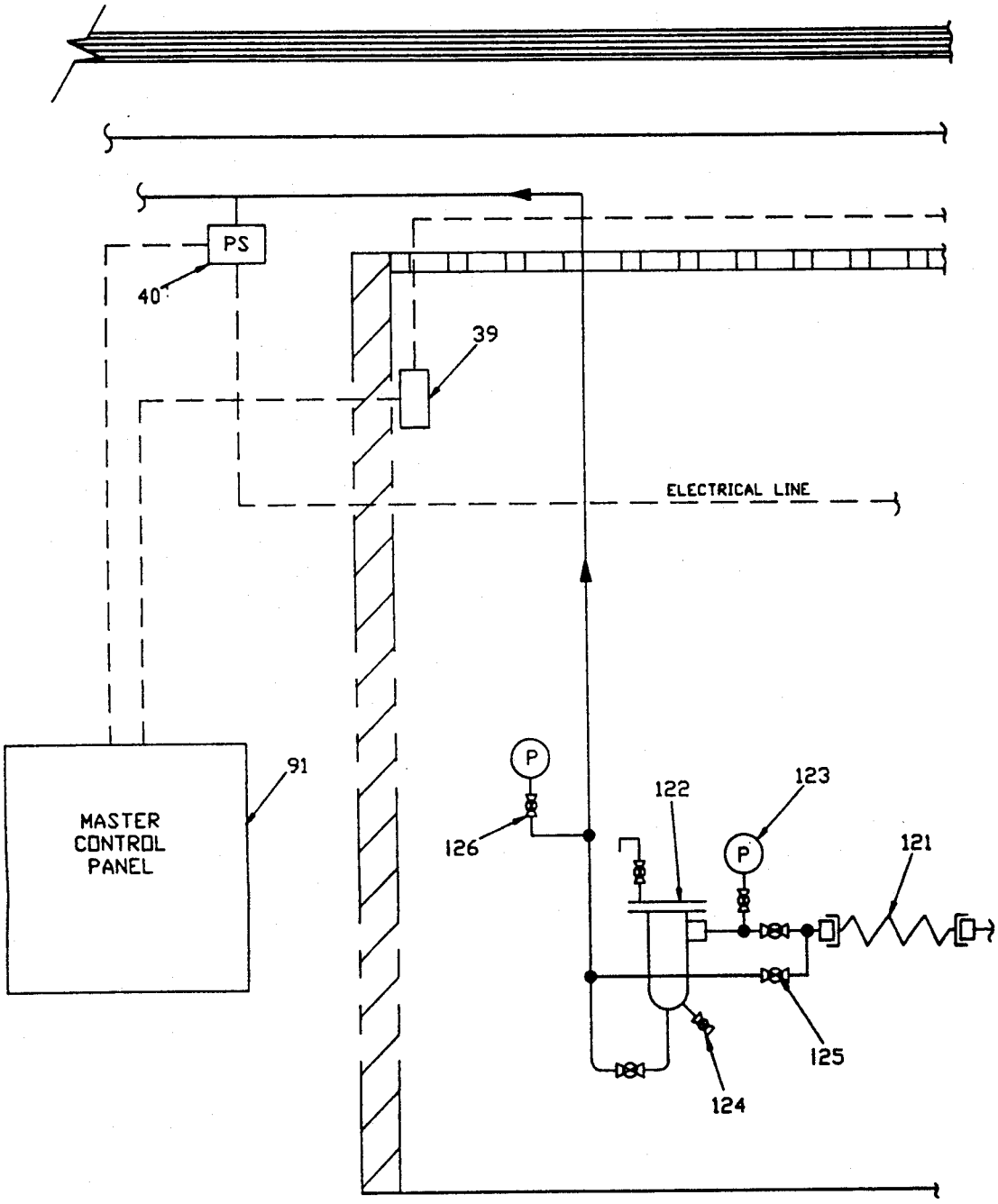
FIG. 11A, B, and C side elevational views of a preferred embodiment of the equipment provided in the waterbase relay room according to the invention.
Figure 11:
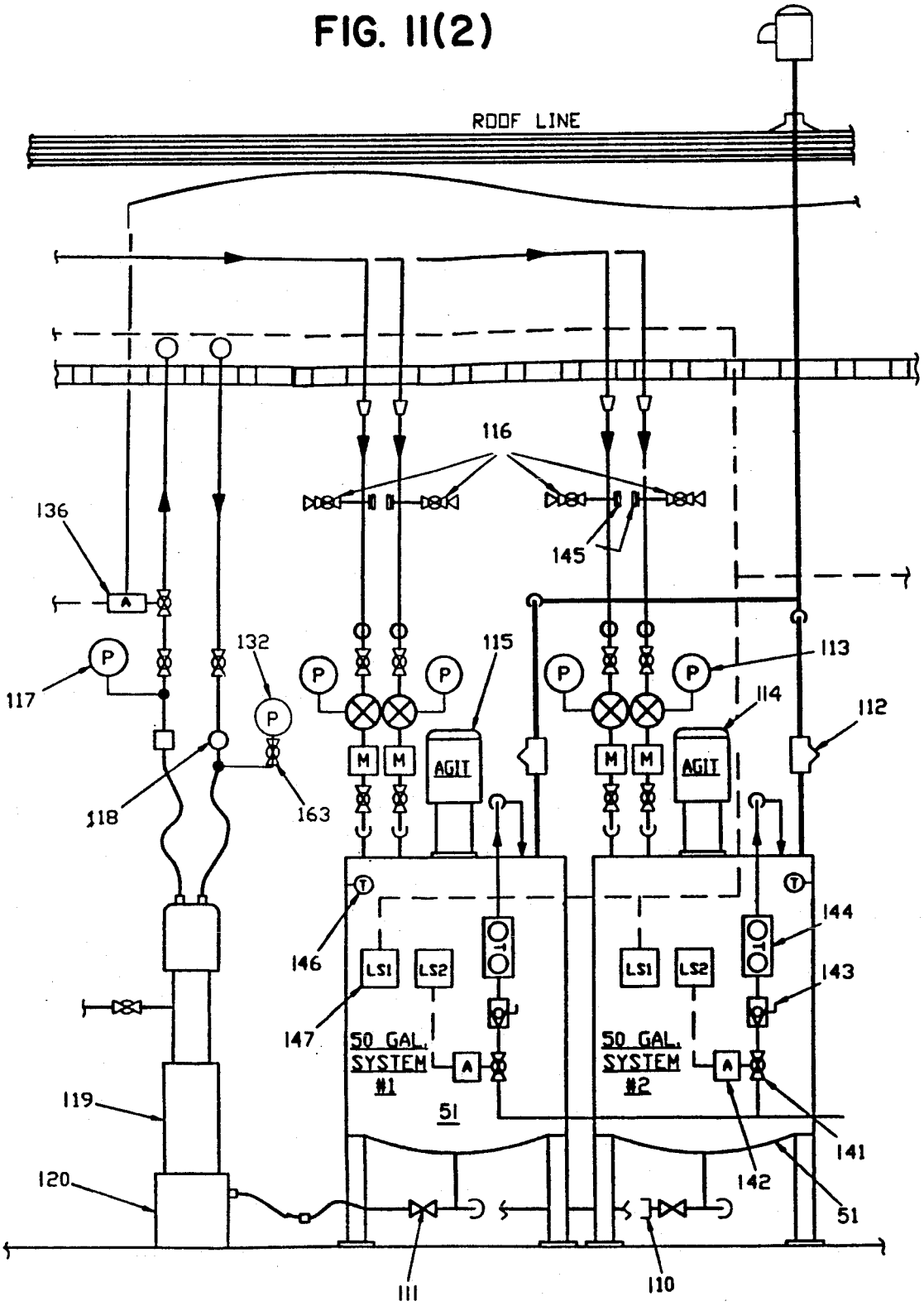
Figure 11:
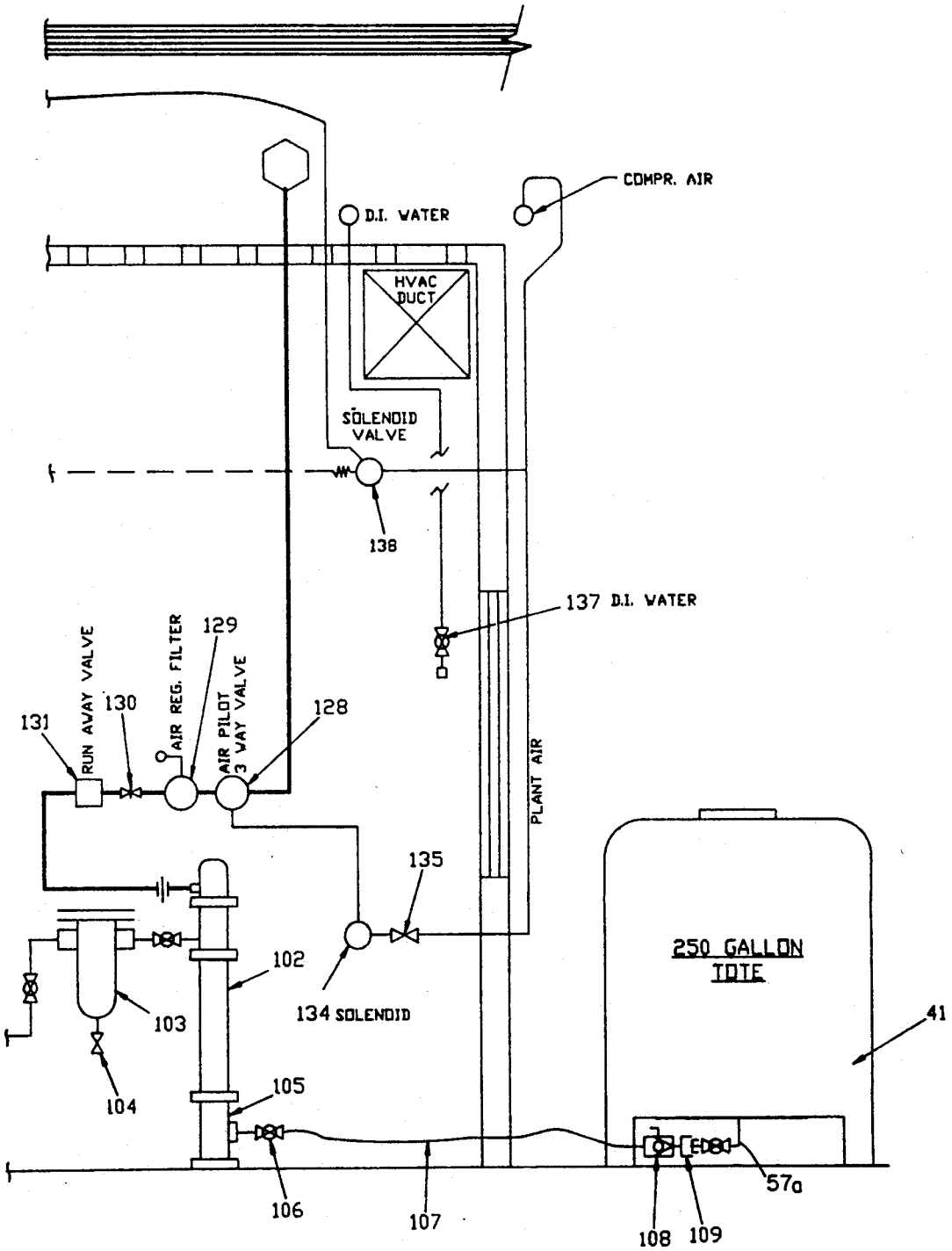

FIG. 11 is a detailed line diagram of the schematic of the pumping station located in the relay room. The tote 41 has its outlet 41*a* connected through a quick disconnect 109 to a check valve 108 connected to a pump suction hose 107 to a pump valve transfer fitting 106, thus to provide paint to a transfer pump stand 105. A transfer pump 102 on the transfer stand 105 pumps paint through a paint filter 103 to the inlet of the shown circulating tank 51. A filter drain valve 104 is provided on the filter for convenience in cleaning and replacing the filter.

The pump 102 is pneumatically operated from an air source 94 providing air through a 3-way air valve 128, an air regulator and filter 129, an air isolation valve 130, and a pump run-away valve 131, connected in series. A compressed air source 95 is connected to an air isolation valve 135 and to a transfer pump solenoid 134.

As described above, DI water is used to clean the lines of the system, and to flush piping during changeover. Thus, a source of DI water is provided to a DI water ball valve 137.

Each of the tanks 51 which are representatively shown is connected to an agitator 115 to maintain motion in the paint in the tanks 51. The return lines return paint to the tanks 51 through a return line drain 116 and through the piping arrangement shown in FIG. 12. A ball valve 141 is connected to an air operator 142 in circuit with a level sensor LS2. A level sensor LS1 cooperates with the sensor LS2 to maintain the paint level in the tank 51 within predetermined narrow limits as previously described. The ball valve 141 is connected to a check valve 143 in circuit with a gear meter 144. A temperature sensor 146 is located on the tank 51 to measure the temperature of the paint in the tank, while a temperature sensor 45 is located in the return line to measure the temperature of the returning paint.

Paint from the outlet of the tanks 51 is provided through a suction line cap 110 through a suction valve 111 to a supply pump 119 located on a pipe stand 120. The pump 119 is hydraulically operated by hydraulic fluid in the lines 90 passing through the hydraulic fluid regulator 118. A hydraulic pressure gage 132 in series with a hydraulic pressure gage isolation valve 163 are also provided. A pressure gage 117 is located in the paint return line for monitoring pressure in the pump supply system. A pressure switch 140 is also provided for sensing the pressure in the outlet line to provide a signal to the control panel 91. An output derived from system overpressure closes valve 138 to shut down in the end result paint pump 119.

The system is equipped with significant safety and operating controls. When a system aberration is sensed by a signal provided to the master control panel 91, a signal is sent to the alarm transmitter panel 39 where a beeper signal is sent to advise responsible personnel of the aberration.

The output from the pump 119 is provided through a supply hose 121 through a quick connect fitting to a paint filter 122 having a paint pressure gauge 123 connected in line. A filter drain valve 124 is provided for the valve for operator convenience in cleaning or replacing the filter. The output from the filter 122 is provided as a supply line to a drop in the paint booth 15 as previously described.

Figure 12:
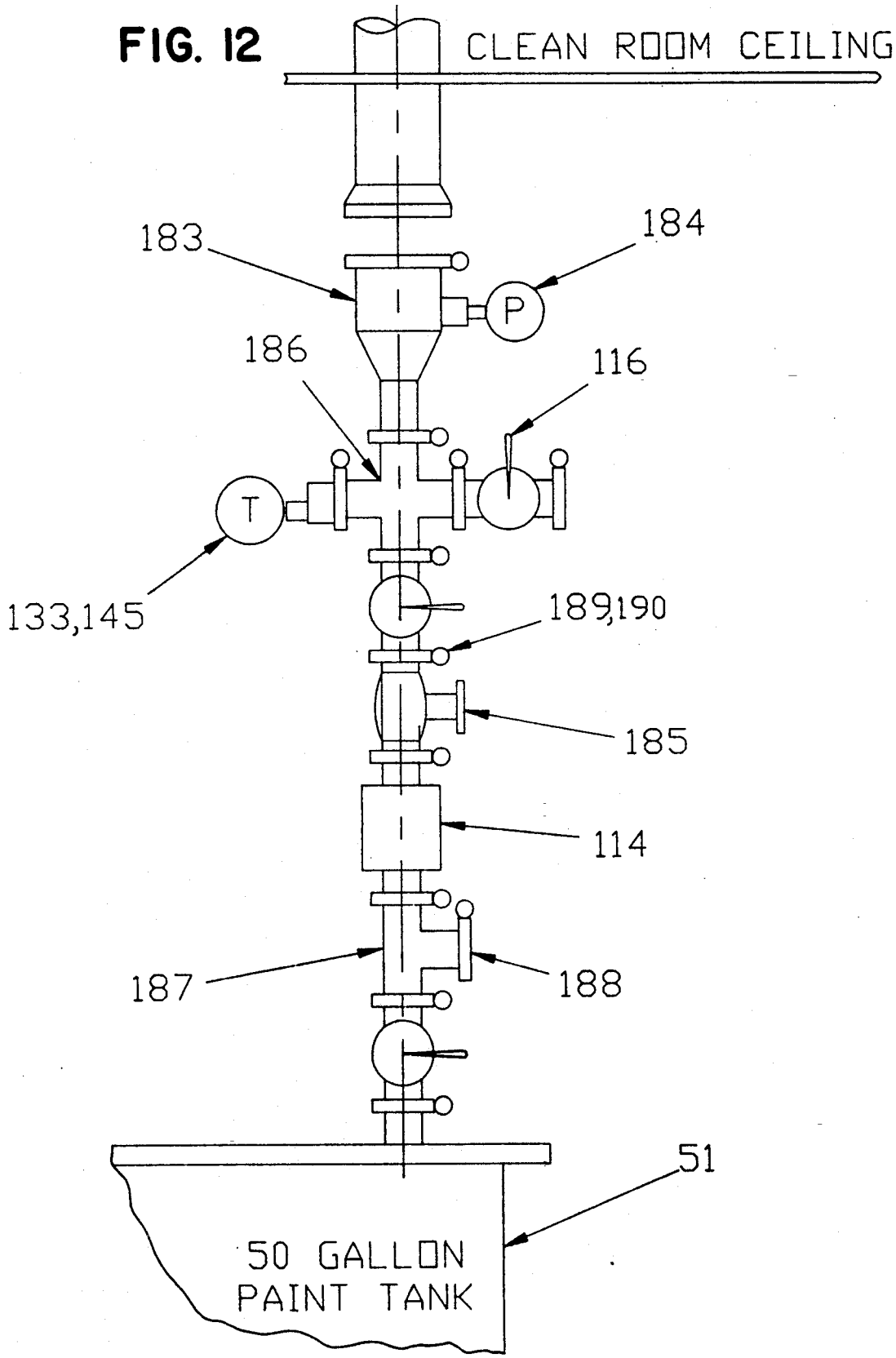
FIG. 12 is a more detailed view of the piping between the return line and the circulating tank.

The details of the return lines are shown in FIG. 12. The return line 96 is connected to a reducer 183 which may be used because the system is basically a single pipe system as described in connection with FIG. 4. There, the system pipes is reduced from 2" to 1". The reducer 183 is connected to a pressure gage 184. The outlet of the reducer is connected to a cross 186 having a temperature gage well 133 connected to a temperature gage 145. The other side of the cross 186 is connected to a manual return line drain valve 116. The outlet of the cross 186 is connected through a valve to a clamp 189 with a gasket 190. A pinch valve 185 is connected to the outlet as described and to a paint flow meter 114 for monitoring return flow. A tee 187 and a cap 188 complete the piping for the return station for the paint return lines.

Thus, as can be understood from the foregoing, the water-based material is delivered to the factory in bulk stainless steel containers, and stored in inventory in an explosion proof building along with the solvent based products for compliance with codes and laws governing combustible product storage remote to the main plant. A paint mix associate, knowing the daily production requirements for the colors to be painted, selects the paint totes which will be required for delivery to the relay room where samples are taken for static viscosity and ph levels. The tote is weighed for entry to an automated material usage tracking sequence on a data processor. The processor subtracts the known weight of an empty paint tote and converts the given data into engineering units of volume in gallons according to a mathematical formula according to paint color.

When the paint tote is transported and connected to the relay room supply line, paint usage tracking and monitoring begins. As previously explained, each tank has an automatic level control via level sensors interacting with automatic activated fluid shut off vales. As shown in FIGS. 11 and 12, when the level in the circulation tank is lowered, the level sensor 147 provides an input to the processor producing an output to the solenoid valve 134 which in turn pilots the a shut off valve 128 to the open position. This sequence refills the paint recirculation tank to a present level, and the valve 134 is closed.

The gear meter 144 is utilized as a totalizer in this system measuring paint flow through the system, for subtraction from the original supply data. This method permits monitoring of the paint tote volume without any devices in the paint tote itself. When an input is provided to the processor indicating a low level in the tote, an auto dialer is actuated communicating through the plant phone system to the paint mix operator equipped with a beeper. Thus, the system does not require occupancy to keep system from running out of paint.

For added protection, audible horn and visual beacons are energized if the level sensor 147 ever sees a low level condition implying that the paint tote has emptied and that the tank level has traveled below its normal operating level to a second preset low level position. This paint fill and usage tracking sequence demonstrates the use of a 50 gallon tank with only 25 gallons of paint therein to supply a high volume paint operation.

Thus, the basic features of a waterbased paint recirculating system have been shown and described in a way which addresses the problems noted and meets the stated objectives. Thus, while the present invention has been discussed above in terms of the preferred embodiments of the invention and modifications thereof, the invention may be embodied in various ways. Therefore, any embodiments and modification thereof which are implemented without departing from the principal of the invention as defined in the appended claims are within the scope of the invention.

What is claimed is:

1. A paint apparatus for painting a device in a painting spry booth with a paint, comprising:

a painting spray booth in which said device can be placed for painting;

a portable tote for said paint, sized to have a relatively low volume sufficient under applicable regulatory codes regarding said paint for permitting a predetermined plurality of said totes to be collectively located within a factory in a relay room, whereby said relay room need not be an explosion proof space under said applicable regulatory codes when housing said plurality of said totes;

a circulating tank for directly receiving paint from said portable tote and also being sized to have a relatively low volume sufficient under said applicable regulatory codes regarding said paint for permitting a like plurality of circulating tanks to be collectively located within a space in a relay room, whereby said relay room need not be an explosion proof space under said applicable regulatory codes when housing said plurality of said circulating tanks;

automatic control means cooperating with said portable tote and said circulating tank associated with said portable tote for automatically and continuously controlling the volume of said paint within said circulating tank within predetermined volumetric limits; and means for delivering said paint from said circulating tank to a predetermined number of drops in said painting spray booth for painting said device.

2. The painting apparatus as set forth in claim 1, wherein said paint is a waterbased paint and said predetermined plurality of portable totes is determined by applicable codes regulating a quantity of paint which can be stored in said relay room.

3. The painting apparatus as set forth in claim 1, wherein said device is an automotive vehicle which is painted by paint from said drops in said painting spray booth.

4. The apparatus as set forth in claim 3, wherein said plurality of portable totes and said plurality of circulating tanks are located in the same relay room adjacent to said painting spray booth located in an assembly line in an automotive vehicle factory.

5. The apparatus as set forth in claim 1, further including automatic monitoring means for automatically tracking the use of paint through the apparatus to an uninterrupted supply of paint to a high usage volume location of application in he painting spray booth from the low volume supply of the plurality of sources.

6. The paint apparatus as set forth in claim 5, wherein said relay room housing both the circulating tanks and the totes having predetermined volumes is within said code limits for the volume of paint located in said relay room.

7. The paint apparatus as set forth in claim 1, wherein paint from said totes and said tanks does not pass through hot areas of the painting system or a factory to said painting spray booth, thus obviating a need for temperature control for said paint.

8. An apparatus which includes:

a painting spray booth for painting an object from a plurality of paint drops located in said painting spray booth;

a plurality of paint totes having paint therein and located in a relay room adjacent said painting spray booth;

a like plurality of circulating tanks also located in said relay room adjacent said totes for directly receiving a volume of paint from said totes, the volume of paint in said totes and said circulating tanks in said relay room being within code limits for limiting the amount of said paint stored within said relay room;

said painting spray booth having a plurality of paint drops positioned relative to the passage of an automobile body therethrough to paint said body, said paint booth being located adjacent said relay room;

a plurality of pipes respectively connected to said circulating tanks and traversing a side of said booth at a location below the level of said vehicle passing through said booth, said supply pipes passing beneath an end of said booth, and a plurality of return lines to said circulating tanks; and automatic means for automatically monitoring flow of paint from said tote to said circulating tank and to said painting spray booth, including means for controlling volume of said paint in said circulating tanks.

9. The apparatus as set forth in claim 8, wherein said automatic means further includes means for controlling the volume of paint in each of said circulating tanks to within a predetermined limit so that a relatively low volume of paint supply in said circulating tanks services a predetermined relatively high demand for usage in said paint booth.

10. The apparatus as set forth in claim 9, further including means responsive to said monitoring means for providing a signal indicative of a low volume of paint remaining in said totes for replacement of said totes.

* * * * *